United States Patent [19]

Gruenbaum et al.

[11] Patent Number: 4,968,571

[45] Date of Patent: Nov. 6, 1990

[54] ELECTROPHOTOGRAPHIC RECORDING ELEMENTS CONTAINING A COMBINATION OF PHOTOCONDUCTIVE PERYLENE MATERIALS

[75] Inventors: William T. Gruenbaum, Rochester; Khe C. Nguyen, Pittsford; Jeanne E. Kaeding, Rochester, all of N.Y.

[73] Assignee: Eastman Kodak Company, Rochester, N.Y.

[21] Appl. No.: 384,376

[22] Filed: Jul. 21, 1989

[51] Int. Cl.[5] ..... G03G 5/047; G03G 5/06

[52] U.S. Cl. ..... 430/58; 430/59; 430/76; 430/78

[58] Field of Search ..... 430/58, 59, 76, 78

[56] References Cited

U.S. PATENT DOCUMENTS

| | | | |
|---|---|---|---|
| 4,156,757 | 5/1979 | Graser et al. | 252/501.1 |
| 4,578,334 | 3/1986 | Borsenberger et al. | 430/59 |
| 4,714,666 | 12/1987 | Wiedemann et al. | 430/59 |
| 4,719,163 | 1/1988 | Staudenmayer et al. | 430/58 |
| 4,742,170 | 5/1988 | Spietschka et al. | 546/37 |
| 4,769,460 | 9/1988 | Spietschka et al. | 546/37 |
| 4,792,508 | 12/1988 | Kazmaier et al. | 430/78 X |

FOREIGN PATENT DOCUMENTS

| | | | |
|---|---|---|---|
| 63-89865 | 4/1988 | Japan | 430/78 |
| 63-266457 | 11/1988 | Japan | 430/78 |

*Primary Examiner*—Roland E. Martin

*Attorney, Agent, or Firm*—Alfred P. Lorenzo

[57] ABSTRACT

An electrophotographic recording element comprising a combination of photoconductive perylene materials that are dispersed in a binder to form layers having excellent photosensitivity and resistance to abrasion. The materials are perylene-3,4,9,10-tetracarboxylic acid imide derivatives that contain a phenethyl radical bonded to a 3,4-dicarboximide nitrogen atom.

11 Claims, No Drawings

ELECTROPHOTOGRAPHIC RECORDING ELEMENTS CONTAINING A COMBINATION OF PHOTOCONDUCTIVE PERYLENE MATERIALS

FIELD OF THE INVENTION

This invention relates to electrophotographic recording elements containing a combination of photoconductive perylene materials. More particularly, the invention relates to such elements containing a combination of perylene-3,4,9,10-tetracarboxylic acid imide derivatives that can be coated in a dispersion to form layers that exhibit unexpectedly good photosensitivity in the visible region of the spectrum. Such layers are highly resistant to abrasion and, therefore, exhibit good durability.

BACKGROUND

In electrophotography an image comprising an electrostatic field pattern, usually of non-uniform strength (also referred to as an electrostatic latent image), is formed on an insulative surface of an electrophotographic element comprising at least a photoconductive layer and an electrically conductive substrate. The electrostatic latent image is usually formed by imagewise radiation-induced dissipation of the strength of portions of an electrostatic field of uniform strength previously formed on the insulative surface. Typically, the electrostatic latent image is then developed into a toner image by contacting the latent image with an electrographic developer. If desired, the latent image can be transferred to another surface before development.

In latent image formation the imagewise radiation-induced dissipation of the initially uniform electrostatic field is brought about by the creation of electron/hole pairs, which are generated by a material, often referred to as a photoconductive or charge-generation material, in the electrophotographicc element in response to exposure to imagewise actinic radiation. Depending upon the polarity of the initially uniform electrostatic field and the types of materials included in the electrophotographic element, part of the charge that has been generated, i.e., either the holes or the electrons, migrates toward the charged insulative surface of the element in the exposed areas and thereby causes the imagewise dissipation of the initial field. What remains is a non-uniform field constituting the electrostatic latent image.

Several types of electrophotographic recording elements are known for use in electrophotography. In many conventional elements, the active photoconductive materials are contained in a single layer. This layer is coated on a suitable electrically conductive support or on a non-conductive support that is overcoated with an electrically conductive layer. In addition to single-active-layer electrophotographic recording elements, various multi-active electrophotographic recording elements are known. Such elements are sometimes called multi-layer or multi-active-layer elements because they contain at least two active layers that interact to form an electrostatic latent image.

A class of photoconductive materials useful in the aforementioned single-active-layer and multiactive elements is the class of perylene pigments, particularly perylene-3,4,9,10-tetracarboxylic acid imide derivatives. Such perylene photoconductive materials are often capable of providing exceptional performance in such elements. For example, U.S. Pat. No. 4,578,334, issued Mar. 25, 1986, describes multi-active electrophotographic recording elements that contain, as photoconductive materials, certain crystalline forms of N,N'-bis(2-phenethyl)perylene-3,4:9,10-bis(dicarboximide) characterized by particular spectral absorption and x-ray diffraction characteristics. Also, U.S. Pat. No. 4,714,666, issued Dec. 22, 1987, describes single-active-layer electrophotographic elements and multi-active elements containing, as photoconductive materials, asymmetrically substituted perylene-3,4,9,10-tetracarboxylic acid imide derivatives. In addition, U.S. Pat. No. 4,719,163, issued Jan. 12, 1988, describes multi-active electrophotographic elements that contain, as photoconductive materials, the compound N,N'-bis[2-(3-methylphenyl)ethyl]perylene-3,4:9,10-bis(dicarboximide).

Unfortunately, electrophotographic recording elements of the prior art have typically suffered from one or more disadvantages that have significantly restricted their use. For example, vacuum sublimation is frequently required to deposit photoconductive perylene materials in a crystal form suitable for high speed electrophotographic elements. Vacuum sublimation, however, requires expensive equipment for production scale runs and thin sublimed films are fragile and susceptible to damage until they can be protected by a more durable overcoat. It is evident therefore, that electrophotographic recording elements comprising photoconductive perylene materials that provide high photosensitivity without requiring vacuum sublimation coating techniques would represent a significant advance in the art. It is an objective of this invention to provide such electrophotographic recording elements.

SUMMARY OF THE INVENTION

In accordance with this invention, certain combinations of at least two perylene photoconductive materials act synergistically to provide electrophotographic elements having unexpectedly high photosensitivity. Such combinations of perylene photoconductive materials are capable of forming stable, uniform dispersions in organic liquids that can be coated to provide electrophotographic elements having excellent photosensitivity, for example, photodischarge speed and dark decay, without the need for vacuum sublimation techniques. Furthermore, the electrophotographic elements of this invention exhibit a broad range of sensitivity, i.e., they exhibit excellent electrophotographic response over the visible region of the spectrum (400–700 nm) and often exhibit an unexpected increase in electrophotographic response at all wavelengths within such region. Thus, this invention provides an electrophotographic element that comprises a combination of (A) a perylene-3,4:9,10-bis(dicarboximide) with (B) a perylene-3,4-dicarboximide containing a 9,9a,10-fused imidazo[1,2-a]pyridino ring moiety, wherein each of these photoconductive materials has a phenethyl radical bonded to the 3,4-dicarboximide nitrogen atom and the combination is dispersed in a binder.

As described in greater detail hereinafter, the presence of a phenethyl radical bonded to a 3,4-dicarboximide nitrogen atom as described, i.e., a radical in which an ethylene linkage joins a phenyl moiety to a 3,4-dicarboximide nitrogen atom, is a critical structural feature of the perylene photoconductive materials employed in the practice of this invention. The phenyl moiety can be unsubstituted or it can contain substituents such as alkyl, aralkyl, etc. that do not deleteriously affect photoconductive properties. As illustrated in the following Example 3, closely structurally related perylene photoconductive materials, for example, those in which a benzyl radical is substituted for a phenethyl radical, fail to provide the increased electrophotographic response obtained according to this invention.

DESCRIPTION OF THE PREFERRED EMBODIMENTS

The perylene photoconductive materials employed in the practice of this invention can be readily synthesized according to procedures well known to those skilled in the art. The (A) perylene photoconductive materials include those having the following Formula I and the (B) perylene photoconductive materials include those having the following Formula II,

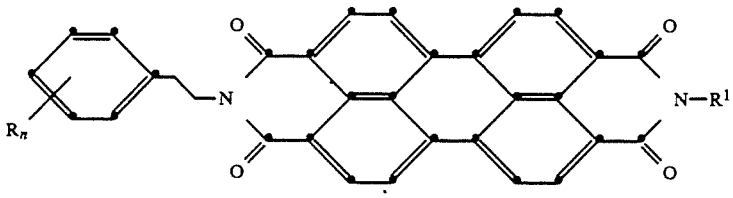

(I)

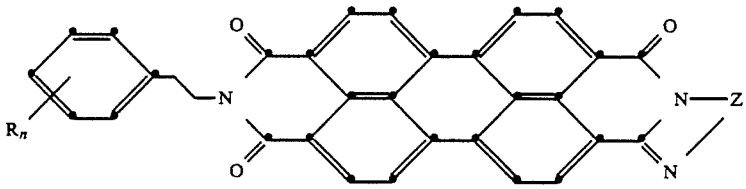

(II)

where each R is alkyl, cycloalkyl, aralkyl, aryl, heteroaryl, alkoxy, dialkylamino, halogen, cyano, amino or nitro;

n is a number from 0 to 5;

$R^1$ is hydrogen, alkyl, cycloalkyl, aralkyl, aryl, heteroaryl, alkoxy, mono- or dialkylamino, or when the compound of Formula I is a dimer, $R^1$ is 1,4-phenylene;

Z is 2,3-naphthylene, 2,3-pyridylene, 3,4-pyridylene, 3,4,5,6-tetrahydro-1,2-phenylene, 9,10-phenanthrylene, 1,8-naphthylene, the radical

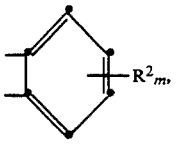

where $R^2$ is alkyl, cycloalkyl, aralkyl, aryl, heteroaryl, alkoxy, dialkylamino, halogen, cyano, or nitro, or when the compound of Formula II is a dimer, Z is 1,2,4,5-benzenetetrayl or 3,3',4,4'-biphenyltetrayl, and m is a number from 0 to 4.

The (A) perylene materials can be symmetrical or unsymmetrical depending upon the nature of the $R^1$ radical in a specific derivative while (B) perylene materials are unsymmetrical. In addition to those specific radicals set forth in the preceding paragraph, illustrative R and $R^2$ substituents include alkyl radicals, such as methyl, ethyl, propyl, isopropyl, butyl, isobutyl, sec-butyl, and tert-butyl; cycloalkyl radicals such as cyclopropyl, cyclobutyl, cyclopentyl and cyclohexyl; aralkyl radicals such as benzyl and phenethyl; aryl radicals such as phenyl, chlorophenyl, anisyl, biphenyl and naphthyl; heteroaryl radicals such as pyridyl, pyrimidyl, thiophenyl, pyrrolyl and furyl; alkoxy radicals such as methoxy and ethoxy; dialkylamino radicals containing the same or different alkyls such as dimethylamino, diethylamino, and methylbenzylamino; and halogen such as chlorine, bromine or fluorine. Some illustrative $R^1$ substituents include alkyl radicals such as methyl, ethyl, propyl, butyl, pentyl, hexyl, methoxyethyl and methoxypropyl; cycloalkyl radicals such as cyclopropyl, cyclobutyl, cyclopentyl and cyclohexyl; aralkyl radicals such as benzyl, phenethyl, phenylpropyl and phenylbutyl; aryl radicals such as phenyl, tolyl, xylyl, biphenylyl and naphthyl; and heteroaryl radicals such as pyridyl and pyrimidyl.

As illustrated by the previous description of Formulas I and II and the following Tables 1 and 2, the specific R, $R^1$ and $R^2$ radicals are not critical to the operation of the invention and include those radicals that are well known to those skilled in the art to provide specific characteristics such as solubility in a specific electrophotographic composition. Although such radicals generally contain only carbon and hydrogen, they often contain additional atoms such as oxygen, nitrogen, sulfur and halogen. It is also evident from the previous description of Formula II and the following Table 2 that the imidazo[1,2-a]-pyridino ring moiety in the photoconductive perylene materials employed in the practice of this invention can contain a wide variety of substituents, including fused ring systems of carbon and carbon and hetero atoms, each ring containing 5 or more carbon or carbon and hetero atoms such as fused benzene, naphthalene, pyrimidine or pyridine rings.

Symmetrical perylene 3,4,9,10-tetracarboxylic acid imide derivatives used in the practice of this invention are conveniently prepared by cyclizing perylene tetracarboxylic dianhydrides with an excess of suitable organic amines such as phenylethyl amine. Typical procedures are described in U.S. Pat. No. 4,156,757, issued May 29, 1979, and in U.S. Pat. Nos. 4,578,334 and 4,719,163 referred to previously herein. Typical procedures for preparing unsymmetrical perylene-3,4,9,10-tetracarboxylic acid imide derivatives employed in the practice of this invention are described in U.S. Pat. No. 4,714,666 previously referred to herein. Synthesis of the dimeric phenylene-3,4,9,10-tetracarboxylic acid imide derivatives can be carried out by methods analogous to those described in U.S. Pat. No. 4,714,666 except that at least 2 moles of a perylene tetracarboxylic acid monoanhydride monoimide is cyclized by reaction with 1 mole of an appropriate polyfunctional organic amine such as 1,4-phenylenediamine or 1,2,4,5-benzenetetraamine.

A partial listing of (A) perylene photoconductive materials that can be used in the practice of this invention have the following general Formula I in which the substituents are defined in the following Table 1.

TABLE 1

(I)

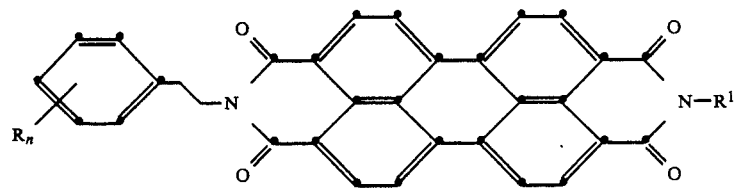

| Compound No. | R* | n | $R^1$ |
|---|---|---|---|
| 1 | — | 0 | 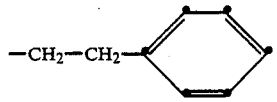 |
| 2 | m-$CH_3$ | 1 | 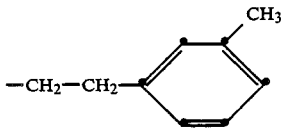 |
| 3 | — | 0 | 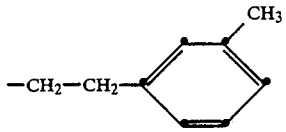 |
| 4 | — | 0 | $-CH_2CH_2CH_3$ |
| 5 | — | 0 | 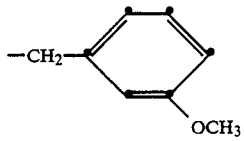 |
| 6 | — | 0 | $-CH_2CH_2CH_2OCH_3$ |
| 7 | — | 0 | $-H$ |
| 8 | — | 0 | 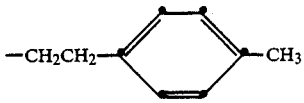 |
| 9 | — | 0 | $-CH_2CH_2OCH_3$ |
| 10 | — | 0 | $-CH_2CH_2CH_2SCH_3$ |
| 11 | — | 0 | 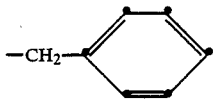 |
| 12 | — | 0 | 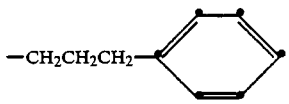 |
| 13 | — | 0 | 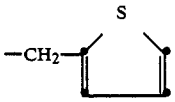 |

TABLE 1-continued
(I)
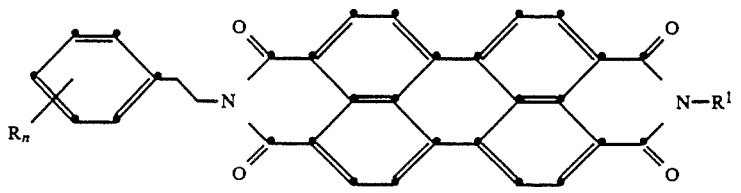
| Compound No. | R* | n | $R^1$ |
|---|---|---|---|
| 14 | — | 0 | 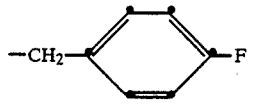 |
| 15 | — | 0 | 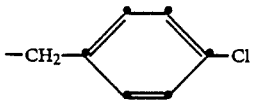 |
| 16 | — | 0 | 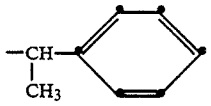 |
| 17 | — | 0 | 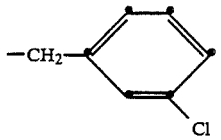 |
| 18 | — | 0 | $-CH_3$ |
| 19 | — | 0 | 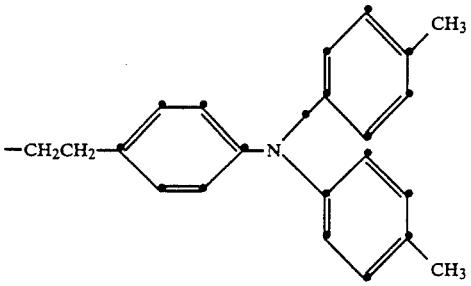 |
| 20 | — | 0 | 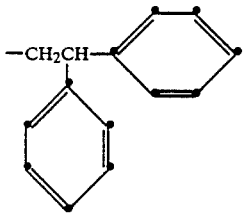 |
| 21 | — | 0 | 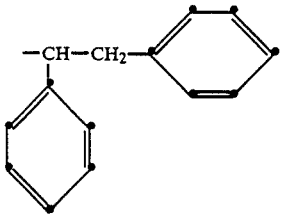 |

TABLE 1-continued
(I)
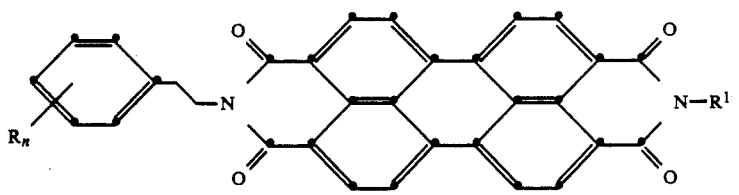
| Compound No. | R* | n | $R^1$ |
|---|---|---|---|
| 22 | — | 0 | 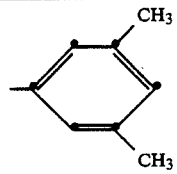 |
| 23 | m-$CH_3$ | 1 | $-CH_2CH_2CH_2OCH_3$ |
| 24 | p-$CH_3$ | 1 | $-CH_2CH_2CH_2OCH_3$ |
| 25 | p-$CH_3$ | 1 | 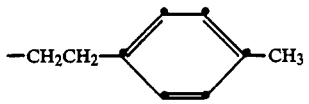 |
| 26 | p-$NH_2$ | 1 | 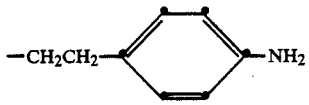 |
| 27 | m-Cl | 1 | 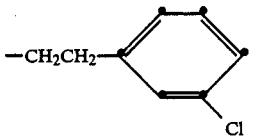 |
| 28 | o-$CH_3$ | 1 | 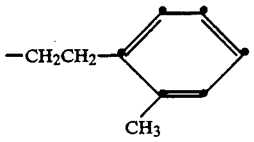 |
| 29 | m-$OCH_3$ | 1 | 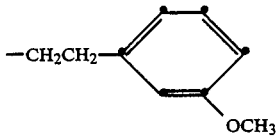 |
| 30 | p-Cl | 1 | 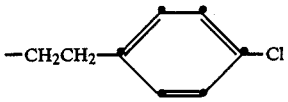 |
| 31 | o-Cl | 1 | 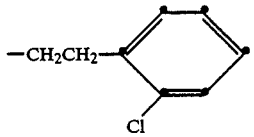 |
| 32 | m-$CF_3$ | 1 | 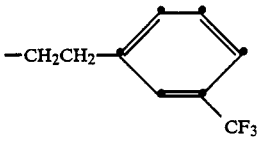 |

TABLE 1-continued
(I)
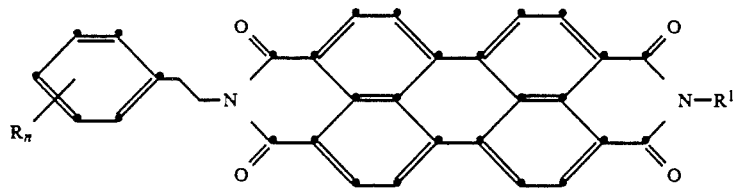
| Compound No. | R* | n | $R^1$ |
|---|---|---|---|
| 33 | m-F | 1 | 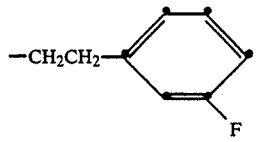 |
| 34 | 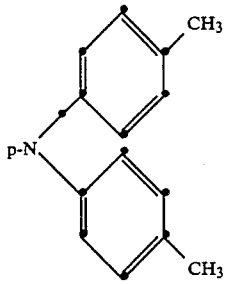 | 1 | 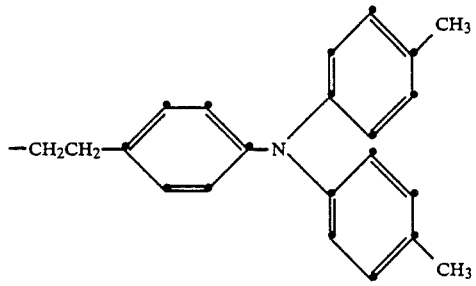 |
| 35 | m, p-Cl | 2 | 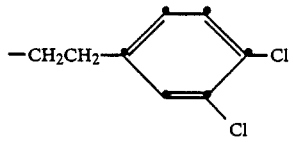 |
| 36 | m, $-OCH_3$ | 2 | 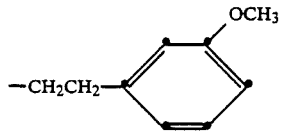 |
| 37 | m, m, p-$OCH_3$ | 3 | 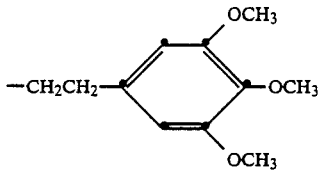 |
*o, m or p indicate substitution in the ortho, meta or para ring positions, respectively.
A partial listing of (B) perylene photoconductive materials that can be used in the practice of this invention have the following general Formula (II) in which the substituents are defined in the following Table 2.

TABLE 2
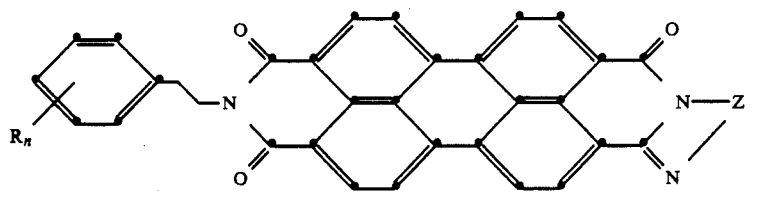
| Compound | n | Z | $R^2$ | m |
|---|---|---|---|---|
| 1 | 0 | 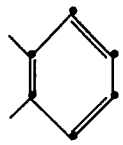 | — | — |
| 2 | 0 | 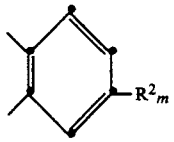  | $CH_3$ | 1 |
| 3 | 0 | 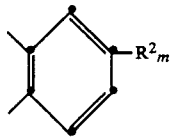  | Cl | 1 |
| 4 | 0 | 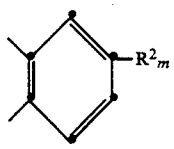  | $NO_2$ | 1 |
| 5 | 0 | 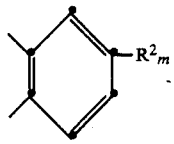  | F | 1 |
| 6 | 0 | 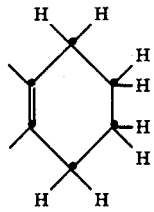  | — | — |
| 7 | 0 | 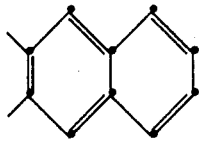 | — | — |
| 8 | 0 | 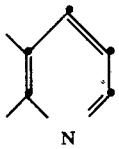  | — | — |

TABLE 2-continued

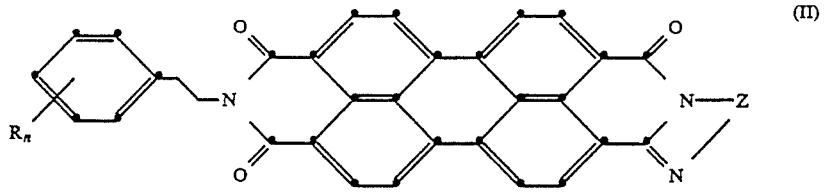

(II)

| Compound | n | Z | $R^2$ | m |
|---|---|---|---|---|
| 9 | 0 | 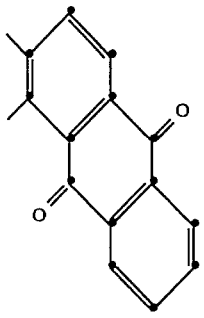 | — | — |
| 10 | 0 | 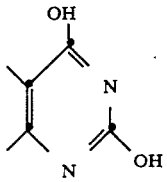 | — | — |
| *11 | 0 | 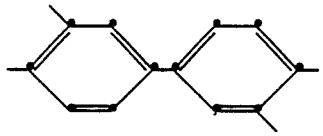 | — | — |
| *12 | 0 | 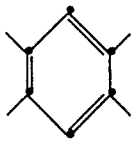 | — | — |

*Dimers

The electrophotographic elements of the invention can be of various types, all of which contain the combination of (A) and (B) photoconductive perylene derivatives that serve as charge-generating materials in the elements. The combination comprises at least one (A) photoconductive perylene derivative with at least one (B) photoconductive perylene derivative although, as shown in the following Example 2, a combination of two (A) derivatives with one (B) derivative provides particularly good results. The inventive elements include both those commonly referred to as single layer or single-active-layer elements and those commonly referred to as multiactive, multilayer, or multi-active-layer elements which have been briefly referred to previously herein.

Single layer elements contain one layer that is active both to generate and to transport charges in response to exposure to actinic radiation. Such elements typically comprise at least an electrically conductive layer in electrical contact with a photoconductive layer. In single layer elements of the invention, the photoconductive layer contains a combination of (A) and (B) photoconductive perylene materials as the charge-generation material to generate charge in response to actinic radiation and a transport material which is capable of accepting charges generated by the charge-generation material and transporting the charges through the layer to effect discharge of the initially uniform electrostatic potential. The photoconductive layer is electrically insulative, except when exposed to actinic radiation, and contains an electrically insulative binder such as a film-forming polymeric binder which may itself be a charge-generating material or may be an additional material which is not photoconductive.

Multiactive elements contain at least two active layers, at least one of which is capable of generating charge in response to exposure to actinic radiation and is referred to as a charge-generation layer (hereinafter also referred to as a CGL), and at least one of which is capable of accepting and transporting charges generated by the charge-generation layer and is referred to as a charge-transport layer (hereinafter also referred to as a CTL). Such elements typically comprise at least an electrically conductive layer, a CGL, and a CTL. Either the CGL or the CTL is in electrical contact with both the electrically conductive layer and the remaining CGL or CTL. Of course, the CGL contains at least a photoconductive material that serves as a charge-generation material; the CTL contains at least a charge-transport material; and either or both layers can contain an additional film-forming polymeric binder. In multiactive elements of the invention the charge-generation material is a combination of (A) and (B) photoconductive perylene derivatives dispersed in a binder and the element contains a CTL. Any suitable charge-transport material can be used in such CTL's.

Single layer and multilayer electrophotographic elements and their preparation and use, in general, are well known and are described in more detail, for example, in U.S. Pat. Nos. 4,701,396; 4,714,666; 4,666,802; 4,578,334; 4,719,163; 4,175,960; 4,514,481; and 3,615,414, the disclosures of which are hereby incorporated herein by reference. The only essential difference of electrophotographic elements of the present invention from generally known elements is that the elements of this invention contain a combination of (A) and (B) photoconductive perylene derivatives that are dispersed in a binder and serve as charge-generation materials. In the combination, the (A) and (B) photoconductive perylene derivatives can each vary in the range of about 1 to 90%, by weight, but the combination is typically 10 to 30% by weight, of (B).

In preparing single-active-layer electrophotographic elements of the invention, the components of the photoconductive layer, including any desired addenda, can be dissolved or dispersed together in a liquid and can be coated on an electrically conductive layer or support. The liquid is then allowed or caused to evaporate from the mixture to form the permanent layer containing from about 0.01 to 50 weight percent of the charge-generation materials and about 10 to 70 weight percent of a suitable charge transport material. Included among many useful liquids for this purpose are, for example, aromatic hydrocarbons such as benzene, toluene, xylene and mesitylene; ketones such as acetone, butanone and 4-methyl-2-pentanone; halogenated hydrocarbons such as methylene chloride, chloroform and ethylene chloride; ethers, including ethyl ether and cyclic ethers such as dioxane and tetrahydrofuran; and mixtures thereof.

In preparing multiactive electrophotographic elements of the invention, the components of the CTL can similarly be dissolved or dispersed in such a liquid coating vehicle and can be coated on either an electrically conductive layer or support or on a CGL previously similarly coated or otherwise formed on the conductive layer or support. In the former case a CGL is thereafter coated on the CTL.

Various electrically conductive layers or supports can be employed in electrophotographic elements of the invention, such as, for example, paper (at a relative humidity above 20 percent); aluminum-paper laminates; metal foils such as aluminum foil and zinc foil; metal plates such as aluminum, copper, zinc, brass and galvanized plates; vapor deposited metal layers such as silver, chromium, vanadium, gold, nickel, and aluminum; and semiconductive layers such as cuprous iodide and indium tin oxide. The metal or semiconductive layers can be coated on paper or conventional photographic film bases such as poly(ethylene terephthalate), cellulose acetate and polystyrene. Such conducting materials as chromium and nickel can be vacuum-deposited on transparent film supports in sufficiently thin layers to allow electrophotographic elements prepared therewith to be exposed from either side.

When coating a photoconductive layer of a single-active-layer element or a CGL of a multiactive element of the invention, a binder such as a film-forming polymeric binder is employed to coat a solution or dispersion of the layer components. The binder may, if it is electrically insulating, help to provide the element with electrically insulating characteristics. It also is useful in coating the layer, in adhering the layer to an adjacent layer, and when it is a top layer, in providing a smooth, easy to clean, wear-resistant surface. A significant feature of this invention is that a CGL containing the (A) and (B) photoconductive perylene derivatives in a binder exhibits a surface that is much more durable than a comparable layer containing the same perylene derivatives but formed by vacuum sublimation. This is advantageous in manufacturing operations where such a CGL is subjected to handling prior to overcoating with, for example, a CTL.

The optimum ratio of charge-generation material to binder may vary widely depending on the particular materials employed. In general, useful results are obtained when the amount of active charge-generation material contained within the layer is within the range of from about 0.01 to 90 weight percent, based on the dry weight of the layer.

Representative materials which can be employed as binders in charge-generation layers are film-forming polymers having a fairly high dielectric strength and good electrically insulating properties. Such binders include, for example, styrene-butadiene copolymers; vinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene, poly(methylstyrene); isobutylene polymers; polyesters, such as poly[ethylene-co-alkylenebis(alkyleneoxyaryl)-phenylenedicarboxylate]; phenolformaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloacrylates and vinyl acetate such as poly(vinyl-m-bromobenzoate-co-vinyl acetate); chlorinated poly(olefins), such as chlorinated poly(ethylene); cellulose derivatives such as cellulose acetate, cellulose acetate butyrate and ethyl cellulose; and polyimides, such as poly[1,1,3-trimethyl-3-(4'-phenyl)-5-indane pyromellitimide].

Binders should provide little or no interference with the generation of charges in the layer. Examples of binders that are especially useful include Bisphenol A polycarbonates and polyesters.

Electrophotographic recording elements of the invention can also optionally contain other addenda such as leveling agents, surfactants, plasticizers, sensitizers, contrast-control agents, and release agents, as is well known in the art.

Also, elements of the invention can contain any of the optional additional layers known to be useful in electrophotographic recording elements in general, such as, e.g., subbing layers, overcoat layers, barrier layers, and screening layers.

The following examples are presented to further illustrate the invention.

EXAMPLE 1

An electrophotographic recording element of the invention was prepared as follows:

A 10% solids mixture of 6 g of the photoconductive perylene derivative of Formula I, Compound No. 3 in Table 1, 4 g of the photoconductive perylene derivative of Formula II, Compound No. 1 in Table 2 and 1.67 of a binder comprising a polyester formed from 4,4'-(2-norbornylidene diphenol and terephthalic acid:azelaic acid (40:60 molar ratio) in dioxane was ball milled for 72 hours. The resulting dispersion was coated on a conductive support comprising a thin conductive layer of nickel on poly(ethylene terephthalate) film to provide a charge-generating layer (CGL) of 1 micrometer thickness.

A coating composition for forming a charge-transport layer (CTL) was prepared comprising 11 weight percent solids dissolved in dichloromethane. The solids comprised 4 g of 1,1-bis(di-p-tolylaminophenyl)-3-phenylpropane, a charge-transport material, and 6 g of a binder comprising Bisphenol A polycarbonate. The coating composition was then coated onto the CGL and dried to give a thickness of 22 micrometers. The resulting electrophotographic recording element was then charged to a uniform potential of −500 V, exposed at its maximum absorption wavelength of 630 nm and discharged to −100 V. The energy required in ergs/cm$^2$ was calculated and reported in the following Table 3 as photodecay. The Dark Decay, i.e., the dark discharge rate for the element, observed 15 seconds after charging, was 1–2 V/sec. This illustrates that the element can be adequately charged.

For comparison purposes, this Example was repeated except that 10 g of the photoconductive perylene derivative of Formula I, Compound No. 3 in Table I and 10 g of the photoconductive perylene derivative of Formula II, Compound No. 1 in Table 2 respectively, were substituted for the combination of photoconductive perylene derivatives. These comparative examples were identified as C-1 and C-2 respectively. The photodecay for the resulting electrophotographic recording elements were determined as described previously in this Example 1 and reported in the following Table 3:

TABLE 3

| Example | Photoconductive Material | Photodecay (ergs/cm$^2$) |
|---|---|---|
| 1 | Formula I, Compound 3<br>Formula II, Compound 1 | 18 |
| C-1 | Formula I, Compound 3 | 25 |
| C-2 | Formula II, Compound 1 | 89 |

A comparison between the photodecay values reported in the above table clearly illustrates that the use of a combination of photoconductive perylene derivatives according to this invention provides a synergistic and unexpected increase in photosensitivity. Thus, the value reported for Example 1 is clearly greater than either of the values reported for C-1 and C-2 for the single photoconductive perylene derivatives. In addition, the electrophotographic recording element using the combination of photoconductive perylene derivatives (Example 1) exhibited a significant increase in sensitivity throughout the visible region of the spectrum in comparison to the elements using individual photoconductive perylene pigments as in C-1 and C-2.

EXAMPLE 2

The procedure of Example 1 was repeated except that the CGL of the element was prepared from 4.5 g of the photoconductive perylene derivative of Formula I, Compound No. 1 in Table 1, 4.2 g of the perylene derivative of Formula I, Compound No. 3 in Table 1 and 1.3 g of the photoconductive perylene derivative of Formula II, Compound No. 1 in Table 2.

For comparison purposes, this Example 2 was repeated except that 10 g of the photoconductive perylene derivative of Formula I, Compound No. 1 in Table 2 was used as the sole photoconductive material in the CGL. This comparative example is identified as C-3. The photodecay for the resulting electrophotographic recording element was determined as in Example 1 and the results reported in the following Table 4. The dark decay, determined as in Example 1 was 1–2 V/sec. The photodecay values for comparison elements C-1 and C-2 from Example 1 are also set forth in the following Table 4.

TABLE 4

| Example | Photoconductive Material | Photodecay (ergs/cm$^2$) |
|---|---|---|
| 2 | Formula I, Compound 1<br>Formula I, Compound 3<br>Formula II, Compound 1 | 12 |
| C-1 | Formula I, Compound 3 | 25 |
| C-2 | Formula II, Compound 1 | 89 |
| C-3 | Formula I, Compound 1 | 30 |

A comparison between the photodecay values reported in the above table clearly demonstrates that the combination of photoconductive perylene derivatives is much more photosensitive than any of the individual components of the combination. Also, a comparison of the photodecay values for Example 1 and Example 2 illustrates that the three component combination of this invention provides a significant increase in sensitivity over the two component combination of photoconductive perylene derivatives. Like the two component combination of Example 1, the three component combination of Example 2 also provided a significant increase in sensitivity throughout the visible region of the spectrum in comparison to the elements prepared in C-1, C-2 and C-3.

EXAMPLE 3

As previously indicated herein, a significant feature of this invention is that the photoconductive perylene derivatives contain a phenethyl radical bonded to a 3,4-dicarboximide nitrogen atom. To illustrate, the procedure of Example 1 was repeated except that in one comparison, designated C-4, the perylene derivative of Formula I, Compound No. 3 in Table 1 was replaced by the photoconductive perylene derivative having the formula:

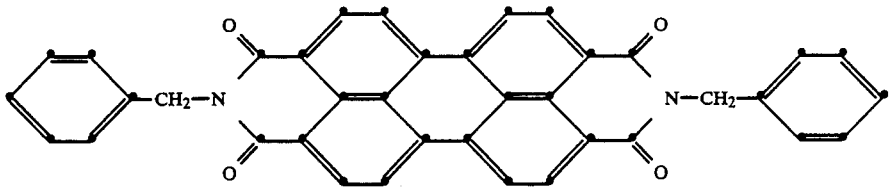

In a second comparison, designated C-5, the procedure of Example 1 was repeated except that the perylene derivative of Formula II, Compound No. 1, Table 2 was replaced by a photoconductive perylene derivative having the formula:

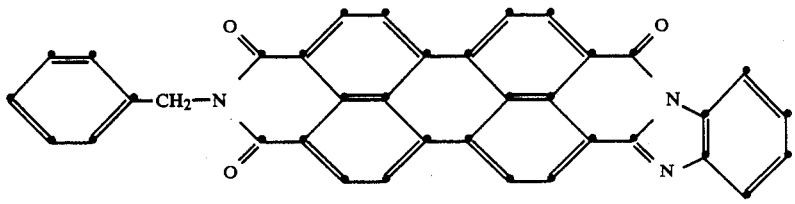

In each of C-4 and C-5, the photodecay was in excess of 200 ergs/cm$^2$, determined as in Example 1. This illustrates the critical nature of the phenethyl radical present in the photoconductive perylene derivatives employed in the practice of this invention.

EXAMPLE 4

The procedure of Example 1 was repeated except that the photoconductive perylene derivative of Formula I, Compound No. 3 in Table 1 was replaced by the photoconductive perylene derivative of Formula I, Compound No. 19 in Table 1. The resulting electrophotographic recording element exhibited substantially the same photodecay and Dark Decay as the element of Example 1.

EXAMPLE 5

The procedure of Example 2 was repeated except that the photoconductive perylene derivative of Formula II, Compound No. 1 in Table 2 was replaced by the photoconductive perylene derivatives of Formula II, Compound Nos. 2, 3, 5, 7, 8 and 9 in Table 2. Each of the resulting electrophotographic recording elements exhibited photodecay and Dark Decay values comparable to those reported in Table 4 for Example 2.

EXAMPLE 6

A mixture of 45 g of photoconductive perylene derivative of Formula I, Compound 1 in Table 1, 42.5 g of the photoconductive perylene derivative of Formula I, Compound 3 in Table 1, 12.5 g of the photoconductive perylene derivative of Formula II, Compound 1 in Table 2 and 6 g of poly(vinylbutyral) binder in 594 g of 4-methyl-2-pentanone was ball milled for 72 hours to provide a dispersion.

A composition was prepared from a mixture of 33.4 g of 3,3-(4-(di-4-tolylamino)phenyl)-1-phenyl propane, a charge-transport material, and 60 g of a binder comprising Bisphenol A-polycarbonate dissolved in 840.6 g of dichloromethane. The composition was stirred with a magnetic stirrer to provide a clear solution.

66 g of the ball milled dispersion was poured into the clear solution and stirred for 10 min. The resulting dispersion was coated on a conductive support comprising a thin conductive layer of nickel on poly(ethylene terephthalate) film to provide a photoconductive coating 12 micrometers thick.

The resulting single-active layer electrophotographic recording element was charged to a uniform potential of +500 V, exposed at its maximum absorption wavelength of 630 nm and discharged to +100 V. The photodecay and Dark Decay were determined as described in Example 1 and the values reported in the following Table 5.

For comparison purposes, this Example 6 was repeated except that 10 g of each of the individual photoconductive perylene derivatives was substituted for the combination of photoconductive perylene derivatives. These comparative examples were identified as C-5a, C-6, and C-7. The photodecay and Dark Decay for the resulting electrophotographic recording elements were determined as described previously in this Example 6 and the values reported in the following Table 5.

TABLE 5

| Example | Photoconductive Material | Photodecay (ergs/cm$^2$) | Dark Decay (V/sec) |
|---|---|---|---|
| 6 | Formula I, Compound 1 Formula I, Compound 3 and Formula II, Compound 1 | 10 | 1 |
| C-5a | Formula I, Compound 1 | 22 | 1 |
| C-6 | Formula I, Compound 3 | 18 | 2 |
| C-7 | Formula II, Compound 1 | 24 | 5 |

A comparison between the photodecay and Dark Decay values reported in the above Table clearly demonstrates the unexpected and superior electrophotographic properties obtained with the combination of photoconductive perylene derivatives according to this invention.

The invention has been described in detail with particular reference to preferred embodiments thereof, but it will be understood that variations and modifications can be effected within the spirit and scope of the invention.

We claim:

1. In an electrophotographic recording element containing photoconductive materials and a charge transport material, the improvement wherein the photoconductive materials comprise a combination of (A) a perylene-3,4:9,10-bis(dicarboximide) with (B) a perylene-3,4-dicarboximide containing a 9, 9a, 10-fused imidazo[1,2-a]pyridino ring moiety, wherein each of these photoconductive materials has a phenethyl radical bonded to the 3,4-dicarboximide nitride atom and the combination is dispersed in a binder.

2. The electrophotographic recording element of claim 1 wherein the perylene photoconductive material (A) has the following Formula I and the perylene photoconductive material (B) has the following Formula II,

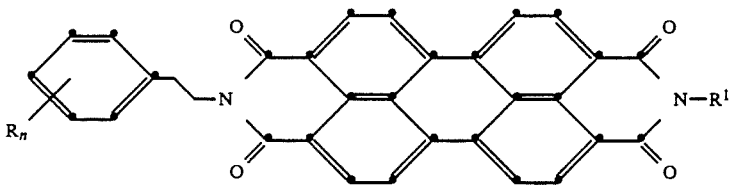

(I)

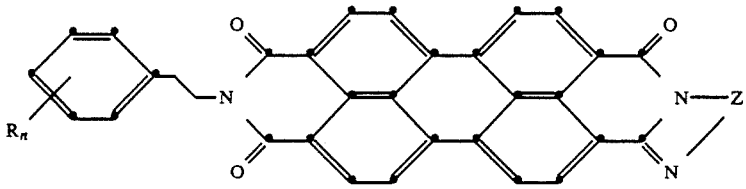

(II)

where each R is alkyl, cycloalkyl, aralkyl, aryl, heteroaryl, alkoxy, dialkylamino, halogen, cyano, amino or nitro;

n is a number from 0 to 5;

$R^1$ is hydrogen, alkyl, cycloalkyl, aralkyl, aryl, heteroaryl, alkoxy, mono- or dialkylamino, or when the compound of Formula I is a dimer, $R^1$ is 1,4-phenylene;

Z is 2,3-naphthylene, 2,3-pyridylene, 3,4-pyridylene, 3,4,5,6-tetrahydro-1,2-phenylene, 9,10-phenanthrylene, 1,8-naphthylene, the radical

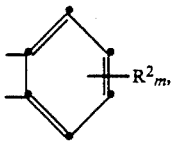

where $R^2$ is alkyl, cycloalkyl, aralkyl, aryl, heteroaryl, alkoxy, dialkylamino, halogen, cyano, or nitro, or when the compound of Formula II is a dimer, Z is 1,2,4,5-benzenetetrayl or 3,3',4,4'-biphenyltetrayl, and m is a number from 0 to 4.

3. The electrophotographic recording element of claim 2, where in Formula I, n is 0 and $R^1$ is aralkyl.

4. The electrophotographic recording element of claim 2, where in Formula I, n is 0 and $R^1$ is phenethyl.

5. The photographic recording element of claim 2, where in Formula I, n is 0 and $R^1$ is methyl-substituted phenethyl.

6. The electrophotographic recording element of claim 2, where in Formula I, n is 0 and $R^1$ is aralkyl and in Formula II, n is 0.

7. The electrophotographic recording element of claim 2, where in Formula I, n is 0 and $R^1$ is phenethyl and in Formula II, n is 0 and z is the radical

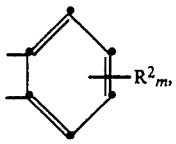

where m is 0.

8. The electrophotographic recording element of claim 2, where in Formula I, n is 0 and $R^1$ is m-methyl-substituted phenethyl and in Formula II, n is 0 and z is the radical

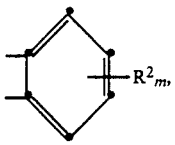

where m is 0.

9. The electrophotographic recording element of claim 2, where in Formula I, n is 0, and $R^1$ is aralkyl and in Formula II, n is 0 and z is the radical

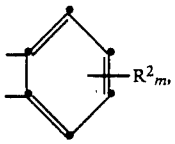

where m is 0.

10. The electrophotographic recording element of claim 2, where the combination comprises two perylene photoconductive materials of Formula I and one perylene photoconductive material of Formula II, where in one perylene of Formula I, n is 0 and $R^1$ is phenethyl and in the second perylene of Formula I, n is 0, $R^1$ is m-methyl-substituted phenethyl and in the perylene of Formula II, n is 0 and z is the radical

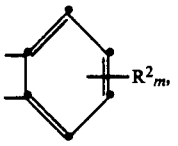

where m is 0.

11.. The electrophotographic element of claim 1, wherein the element is a multiactive element comprising a charge-generation layer containing the combination of perylene photoconductive materials, and a charge-transport layer containing the charge transport material.

* * * * *

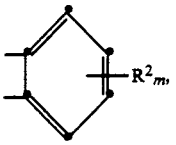

where m is 0.

11. The electrophotographic element of claim 1, wherein the element is a multiactive element comprising a charge-generation layer containing the combination of perylene photoconductive materials, and a charge-transport layer containing the charge transport material.

* * * * *